US006176221B1

(12) United States Patent
Hofmann

(10) Patent No.: US 6,176,221 B1
(45) Date of Patent: Jan. 23, 2001

(54) FUEL DELIVERY SYSTEM

(75) Inventor: Karl Hofmann, Remseck (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/254,071

(22) PCT Filed: Feb. 21, 1998

(86) PCT No.: PCT/DE98/00523

§ 371 Date: Feb. 26, 1999

§ 102(e) Date: Feb. 26, 1999

(87) PCT Pub. No.: WO99/00594

PCT Pub. Date: Jan. 7, 1999

(30) Foreign Application Priority Data

Jun. 28, 1997 (DE) ..... 197 27 543

(51) Int. Cl.[7] ..... F02M 55/02
(52) U.S. Cl. ..... 123/470
(58) Field of Search ..... 123/470, 469, 123/468

(56) References Cited

U.S. PATENT DOCUMENTS 4,213,564 * 7/1980 Hulsing ..... 123/470
4,384,557 * 5/1983 Johnson ..... 123/470
4,709,680 * 12/1987 Turchi et al. ..... 123/470
5,499,612 * 3/1996 Haughney et al. ..... 123/470

FOREIGN PATENT DOCUMENTS 0 569 727 A1 * 4/1993 (EP) .

* cited by examiner

*Primary Examiner*—Henry C. Yuen
*Assistant Examiner*—Arnold Castro
(74) *Attorney, Agent, or Firm*—Ronald E. Greigg; Edwin E. Greigg

(57) ABSTRACT

A fuel delivery system for a fuel injection nozzle, inserted into a cylinder head of an internal combustion engine, having a tubular neck penetrating a passage in the cylinder head. The neck is tightly joined on the inlet side to the connection piece of an inlet tube and is pressed on the outlet side axially with a seat face against a conical seat face, disposed on the nozzle holder of the fuel injection nozzle, by a union screw screwed, into passage of the cylinder head. A check valve is disposed downstream of the conical seat face in the inlet conduit of the injection nozzle, with check valve permits a delivery of fuel solely in the direction of the combustion chamber of the engine.

19 Claims, 6 Drawing Sheets

FUEL DELIVERY SYSTEM

PRIOR ART

The invention relates to a fuel delivery system for a fuel injection nozzle, inserted into a cylinder head of an internal combustion engine, having a tubular neck penetrating a passage in the cylinder head, the neck being tightly joined on the inlet side to the connection piece of an inlet tube and being pressed on the outlet side axially with a sealing face against a conical seat face, disposed on the nozzle holder of the fuel injection nozzle, by means of a union screw screwed into the passage of the cylinder head. One such fuel delivery system is disclosed for instance in European Patent Disclosure EP 0 569 727 A1. In such a fuel delivery system, it is especially advantageous that it enables easy assembly; any slight misalignment of the nozzle holder of the injection nozzle in the cylinder head can be compensated for.

In such fuel delivery systems, however, it can happen that the line pressure after an injection event decreases so rapidly that while the nozzle needle is still open a pressure is established in the fuel injection nozzle that is below the combustion chamber pressure. The result is an expulsion or "blowback" of the combustion gases into the fuel injection nozzle. As a result of this blowback of combustion gases, coke is introduced into the nozzle chamber of the fuel injection nozzle, which is deleterious to the surface life of the fuel injection nozzle.

It is therefore the object of the invention to refine a fuel delivery system of the generic type defined above in such a way as to avert any blowback of the combustion chamber gases into the nozzle chamber.

ADVANTAGES OF THE INVENTION

In a fuel delivery system of the type defined at the outset, this object is attained according to the invention in that a check valve is disposed downstream of the conical seat face in the inlet conduit of the injection nozzle, which check valve permits a delivery of fuel solely in the direction of the combustion chamber of the engine.

By means of this check valve disposed downstream of the conical seat face in the inlet conduit, a blowback of combustion gases into the nozzle chamber is averted in an especially advantageous way, because it is simple to accomplish. Specifically, as soon as a pressure oriented from the combustion chamber into the nozzle chamber is applied to the check valve, this valve closes and thus prevents the combustion gases from entering the nozzle chamber.

Purely in principle, the most various embodiments of the check valve are conceivable. One advantageous embodiment provides that the check valve includes a sealing sleeve, disposed in an opening, and on one end of which conical sealing faces are disposed, and on whose other end a sealing element is provided, which upon imposition of a pressure oriented in the direction of the engine combustion chamber opens the sealing sleeve, and upon a pressure oriented in the reverse direction tightly closes the sealing sleeve. Such a sealing sleeve can be manufactured and installed in a simple way. Another advantage here is that the conical sealing face is disposed on the sealing sleeve itself, so that not only is unproblematic coupling of the inlet tube directly to the sealing sleeve possible, but also the sealing sleeve is secured thereby.

With regard to the sealing element, once again the most various embodiments are conceivable. One advantageous embodiment provides that the sealing element is a throttle plate, which is partly passable and is disposed axially in an opening downstream of the sealing sleeve between it and a bearing face, which throttle plate upon imposition of a pressure oriented toward the combustion chamber is pressed by the sealing sleeve toward the bearing face, the db thereby being opened, and which upon imposition of a pressure oriented away from the combustion chamber is pressed by the bearing face away onto a plane surface on the underside of the sealing sleeve, thereby closing the sealing sleeve. Such a throttle plate can in particular be manufactured and installed simply.

The bearing face on the nozzle holder can be embodied in the most various ways.

One embodiment provides that the bearing face, embodied on the nozzle holder, is an annularly encompassing shoulder in the nozzle holder.

In another, highly advantageous embodiment, it is provided that the bearing face is embodied frustoconically. The conical embodiment of the bearing face and thus also of the region of the throttle plate oriented toward the bearing face has the major advantage in particular that upon imposition of very high pressures, which can occur in an internal combustion engine and are on the order of magnitude of about 1800 bar, the bearing face is practically undamaged, because an abrupt transition, which should be avoided if at all possible, is not created.

On the one hand in order to assure good sealing off of the sealing sleeve by the throttle plate and on the other to present the least possible hindrance to the fuel flowing through the fuel injection nozzle into the combustion chamber, it is provided in an advantageous embodiment that the throttle plate has a centrally disposed sealing face, whose diameter is greater than that of the opening in the sealing sleeve toward the combustion chamber, and that outside the sealing face it has passable openings, whose total cross section is greater than or equal to that of the inlet tube.

To assure that if a very high pressure is imposed the throttle plate will not be destroyed, and on the other hand to enable simple manufacture of the throttle plate and especially of the bearing face, it is provided in an advantageous embodiment that a slotted sleeve provided with a transverse groove is disposed, downstream of the throttle plate, in an opening whose diameter is less than that of the sealing sleeve.

This slotted sleeve acts in a sense as a resilient bearing face for the throttle plate, so that a hard impact of the throttle plate on this bearing face is averted, thus increases the service life of the throttle plate, which can be embodied as a simple platelike element. Furthermore, because of the sealing sleeve, it is also unnecessary to embody a bearing face in the fuel delivery line, this making its manufacture simpler as well.

In another, highly advantageous embodiment, it is provided that a stop bush is press-fitted into the inlet conduit downstream of the throttle plate and has a central opening, which at least partly overlaps the opening or openings in the throttle plate and whose outer diameter is greater than or equal to that of the throttle plate.

This stop bush is easy to manufacture, because only a central opening, which can for instance be a bore, needs to be made. Because its outer diameter is greater than or equal to that of the throttle plate, it furthermore forms a very good seat for the throttle plate in the open state of the check valve. By press-fitting into the inlet conduit, it is assured that an impact of the throttle plate on the stop bush will not cause any shifting of, damage to, or other impairment of the stop bush and of the fuel delivery line.

In another embodiment, it is provided that the check valve is a partly split bolt with a retaining collar, which is disposed in an opening, formed complementary to it, of the fuel delivery line and has spring arms, on its side toward the combustion chamber, that upon imposition of a pressure in the direction of the combustion chamber are pressed toward the axis of the bolt and thereby open an annular passage in the opening, and that upon a pressure reduction yield radially outward away from the axis in the direction of the opening and close the opening.

An especially advantageous aspect of this embodiment is that the check valve is on one piece and therefore is not only simple to manufacture but also simple to install.

In an embodiment of such a check valve, it is preferably provided that the bolt, on its side toward the engine combustion chamber, has a blind opening disposed centrally between the spring arms, into which opening returning fuel flows and is deflected and thereby exerts an additional force radially outward on the spring arms. In this way, if a very high pressure oriented away from the combustion chamber acts upon the check valve, the sealing action of the check valve is increased.

BRIEF DESCRIPTION OF THE DRAWINGS

Further characteristics and advantages of the invention are the subject of the ensuing description and of the drawing showing several exemplary embodiments.

Shown in the drawing are.

DESCRIPTION OF THE EXEMPLARY EMBODIMENTS

Figure 1:
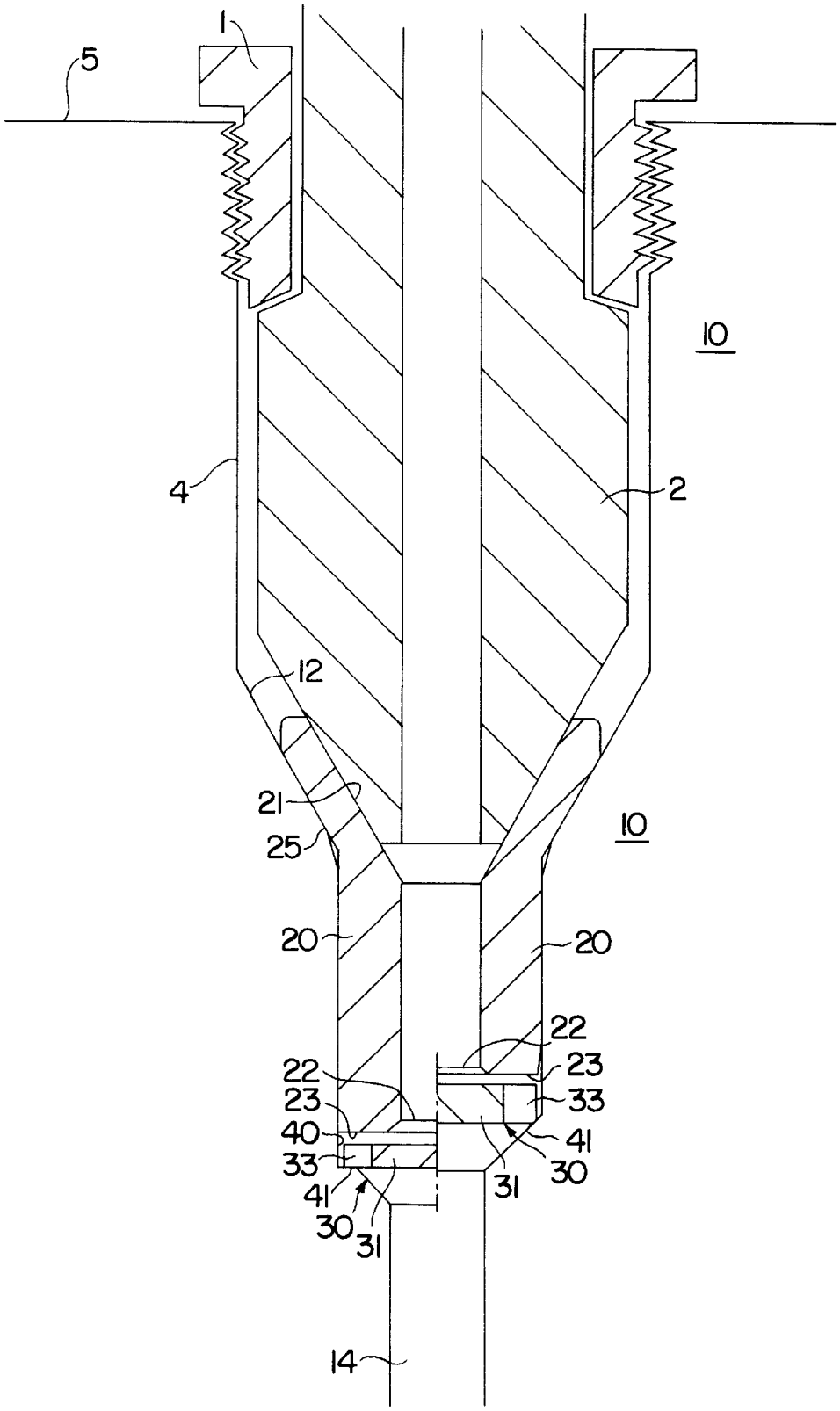
FIG. 1, schematically and each in a half-sectional view, a first and second embodiment of a check valve of a fuel delivery system according to the invention.

A fuel delivery system for a fuel injection nozzle (not shown) used in the cylinder head of an internal combustion engine has a tubular neck 2 that passes into a passage 4 in the cylinder head 5, the neck being tightly joined on the inlet side to the connecting piece of an inlet tube and being pressed on the outlet side with a sealing face axially against a conical seat face 12, disposed on a nozzle holder 10, of the fuel injection nozzle by means of a union screw 1 screwed into the passage in the cylinder head. A check valve, which allows fuel delivery solely in the direction of the combustion chamber of the engine, is disposed in an inlet conduit 14 of the injection nozzle, downstream of the conical seat face 12.

Figure 2:
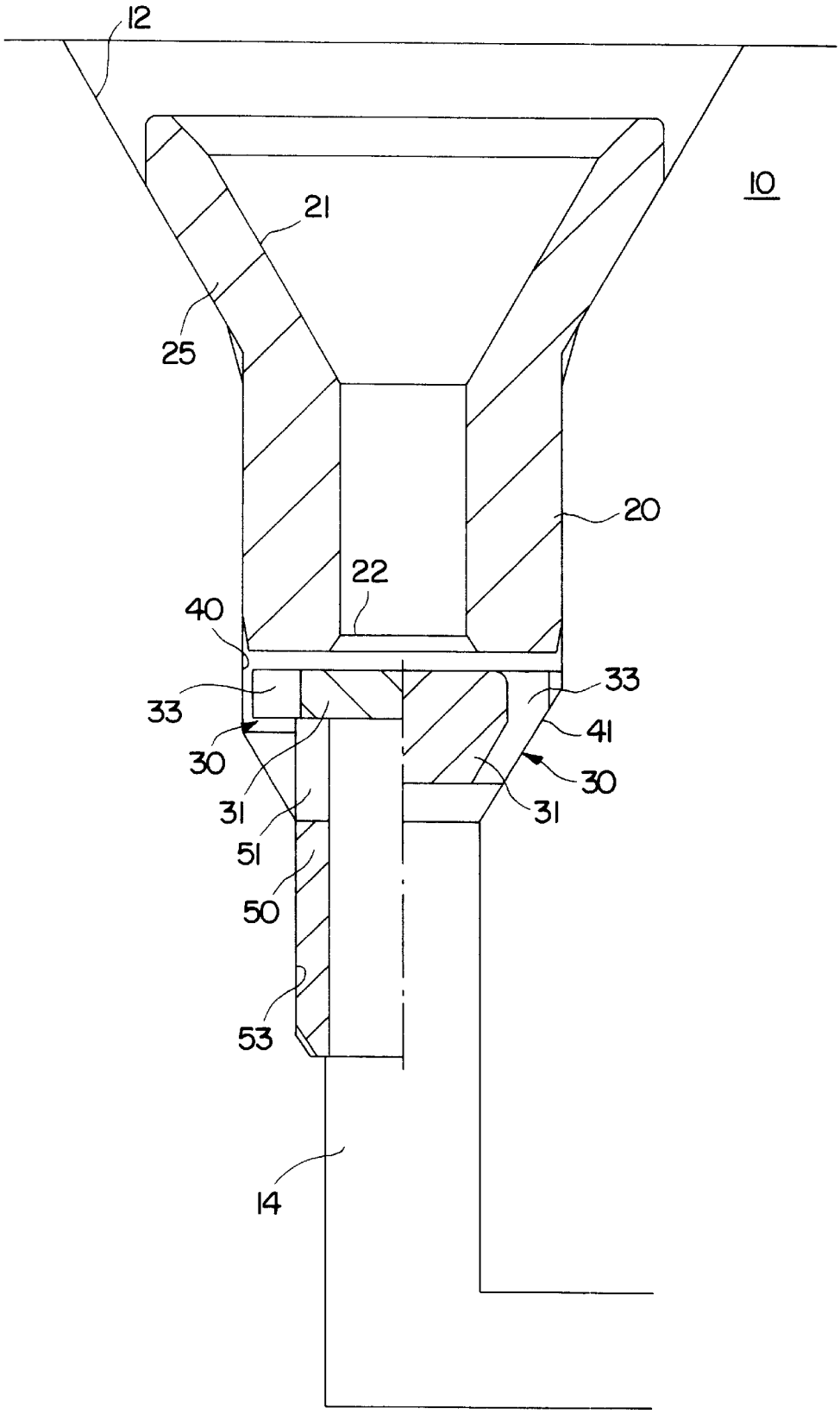
FIG. 2, schematically and each in a half-sectional view, a third and fourth embodiment of a check valve of a fuel delivery system according to the invention.

As shown in FIGS. 1 and 2, this check valve includes a sealing sleeve 20, on one end of which conical sealing faces 21, 25 are disposed, one of which comes to rest on the seat face of the nozzle holder, and on the other of which the sealing face of the tubular neck comes to rest. Because of the embodiment of these conical sealing faces 21, 25, the sealing sleeve 20 can be secured together with the tubular neck in the cylinder head by means of the fact that the seat face of the tubular neck presses the two conical sealing faces 21, 25 of the sealing sleeve against the seat face 12 of the nozzle holder 10.

On the other end of the sealing sleeve 20, a sealing element in the form of a throttle plate 30 is provided, which is displaceable axially in an opening 40 downstream of the sealing sleeve between it and a bearing face 41 embodied in the inlet conduit 14. The throttle plate 30 has a centrally arranged sealing face 31, whose diameter is greater than that of the opening 22 toward the combustion chamber of the sealing sleeve 20. Outside this sealing face 31, passable openings 33 are disposed in the throttle plate, which allow fuel flowing in the direction of the combustion chamber to flow into the inlet conduit 14. The openings 33 have a diameter whose total cross section is greater than or equal to that of the inlet tube 14, so that an unhindered fuel flow into the combustion chamber is made possible.

The function of the throttle plate 31 is as follows: As soon as the throttle plate is acted upon by a pressure oriented toward the combustion chamber, that is, in the direction of the inlet conduit 14, the throttle plate 31 is pressed from the underside of the sealing sleeve 20 away toward the bearing face 41, so that the sealing sleeve 20 is opened and the fuel can flow into the inlet conduit 14.

In the event of a pressure oriented in the opposite direction, that is, a pressure away from the combustion chamber and oriented toward the sealing sleeve 20, the throttle plate 31 is pressed against a plane surface 23 disposed on the underside of the sealing sleeve 20, and closes it tightly, since the sealing face 31 has a diameter which is greater than that of the opening 22, toward the combustion chamber, of the sealing sleeve 20.

The second exemplary embodiment, shown in the right-hand half of FIG. 1, differs from the first explained above only in that the bearing face 41, and thus also the region of the throttle plate 30 that comes to rest on it, are embodied frustoconically. This embodiment is suitable in particular for imposition of very high pressures, which in Diesel engines are on the order of magnitude of approximately 1800 bar, for instance, because in that case, because of the major stress on the material, abrupt and in particular sharp-edged transitions should be avoided to the maximum possible extent.

The embodiment shown in the left half of FIG. 2 differs from that shown in FIG. 1 in that a slotted sleeve 50, provided with transverse grooves 51, is disposed downstream of the throttle plate 30, in an opening 53 whose diameter is smaller than that of the throttle plate 30.

By means of the slotted sleeve 50, on the one hand a resilient bearing face of the throttle plate which is easy to make and is formed by the top of the sleeve is achieved. On the other, the throttle plate can be manufactured in a simple way as a platelike part, and thus conical sides, of the kind in the embodiment shown on the right in FIG. 1, can be dispensed with.

Figure 3:
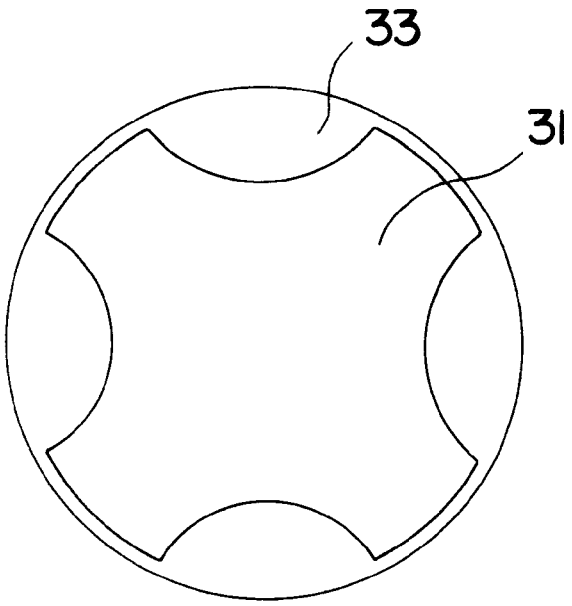
FIG. 3, a plan view of a throttle plate, which is used in the third embodiment of a check valve shown in FIG. 2.

A plan view on the throttle plate shown on the left in FIG. 2 is shown in FIG. 3. As seen from FIG. 3, the fuel flows through the opening 33 and enters the inlet conduit 14 via the transverse grooves 51 disposed in the slotted sleeve 50.

Figure 4:
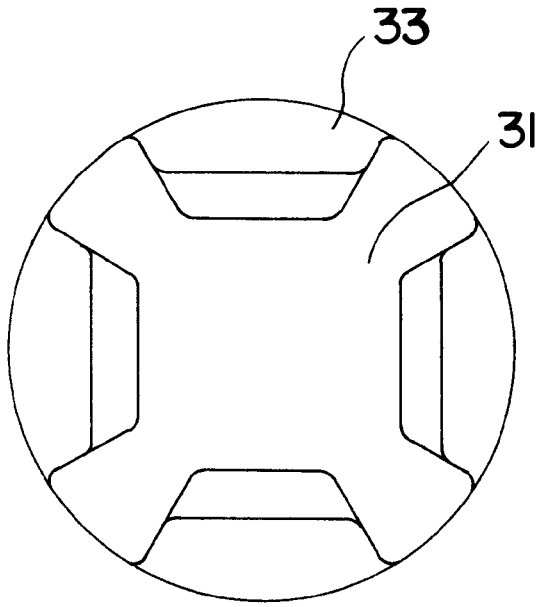
FIG. 4, a plan view of a throttle plate, which is used in the fourth embodiment of a check valve shown in FIG. 2.

In the other embodiment of a check valve of a fuel delivery system, shown in FIGS. 2 and 4, the throttle plate 30 has conical sides, which as in the embodiment shown on the right in FIG. 1 rest on conical bearing faces 41 of the nozzle holder. Unlike the embodiment shown on the right in FIG. 1, however, the openings 33 are embodied at least in part in conical form and extend partly parallel to the bearing face 41 embodied in the nozzle holder.

Figure 5:
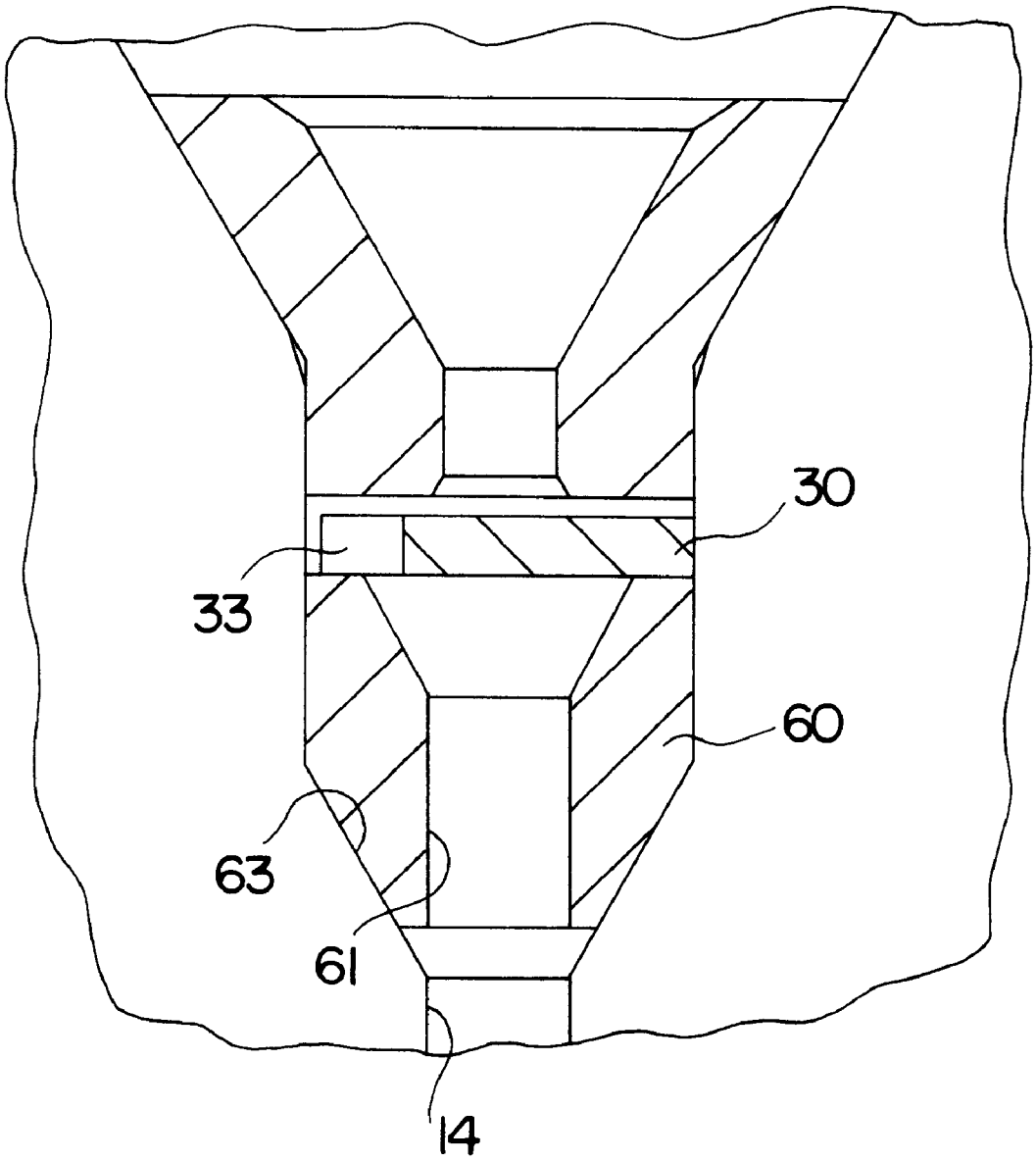
FIG. 5, a sectional view of a fifth embodiment of a check valve of a fuel delivery system according to the invention.

The embodiment of a check valve of a fuel delivery system shown in FIG. 5 again has a throttle plate or throttle disk 30, in which three openings 33 are provided, offset from one another at equal angles.

A stop bush 60 is press-fitted into the inlet conduit downstream of this throttle plate 30.

In the stop bush 60, an opening 61 is provided, which on its side toward the throttle plate 30 extends conically and partly overlaps with the openings 33 provided in the throttle plate 30, so that in this way, when the throttle plate 30 rests on the stop bush 60, a passage for the inflowing fuel exists.

The stop bush press-fitted into the inlet conduit 14 has a diameter which is greater than the outer diameter of the throttle plate 30.

The throttle plates 30 shown in FIGS. 1–5 can be made especially simply from steel or ceramic, for instance by cold hammering, stamping or sintering. If the throttle plates are embodied as ceramic parts, then in particular the low mass is extremely advantageous for the sake of rapid response of the check valve on the one hand and very generally with a view to reducing weight.

Figure 6:
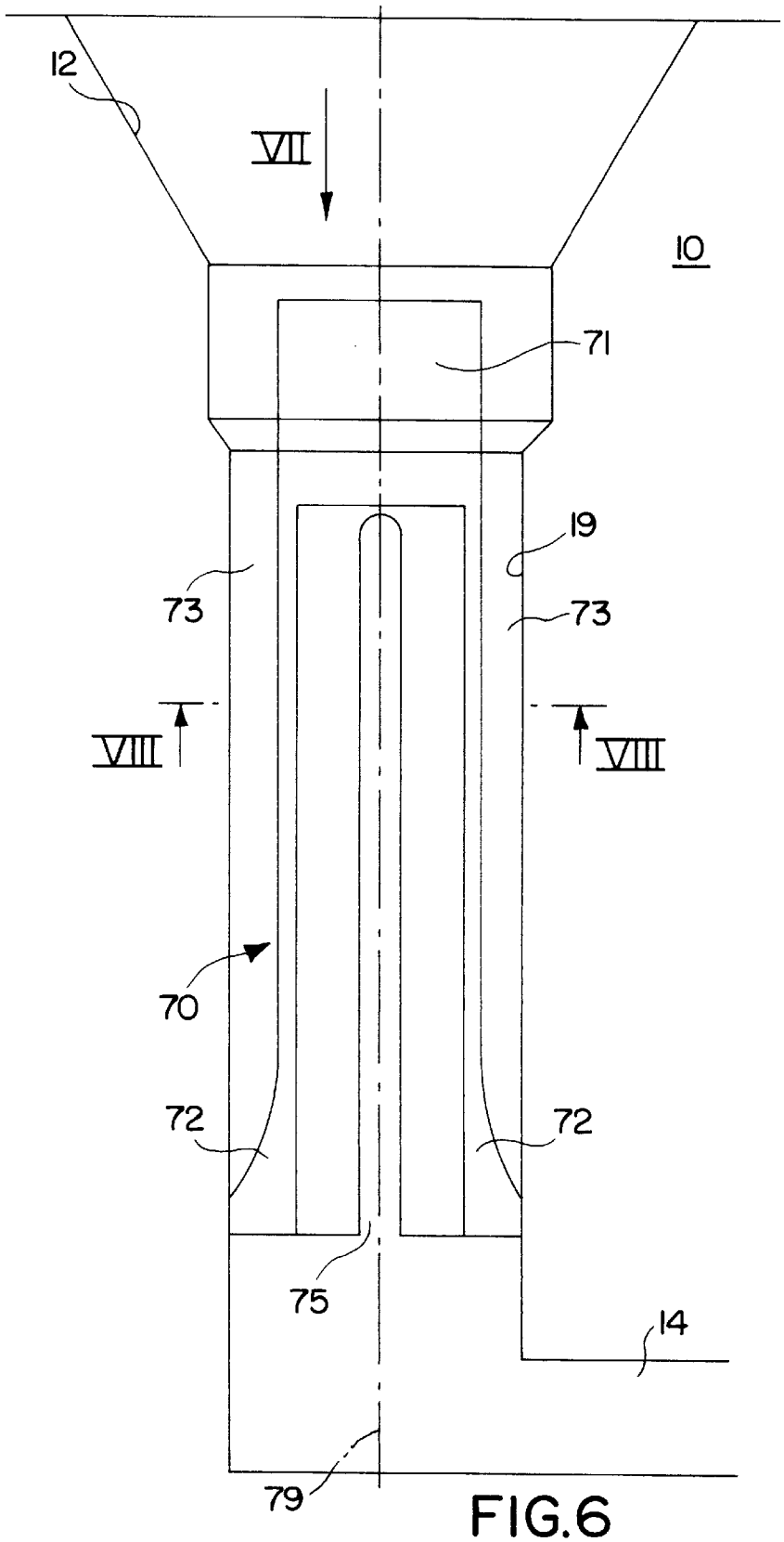
FIG. 6, a sectional view of a sixth embodiment of a check valve of a fuel delivery system according to the invention.
Figure 7:
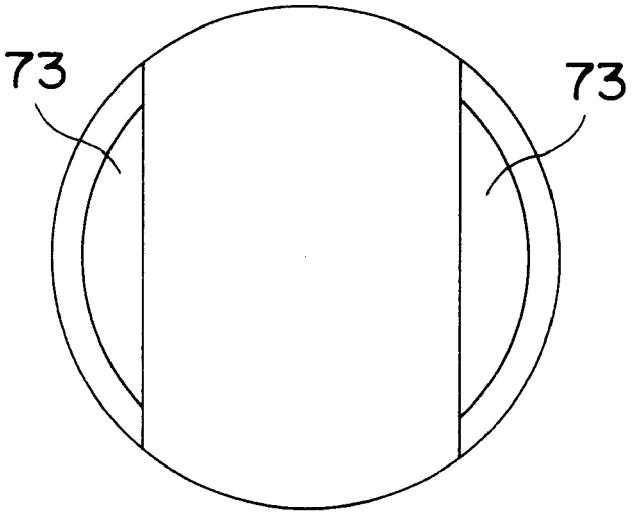
FIG. 7, a plan view in the direction of the check valve marked VII in FIG. 6.
Figure 8:
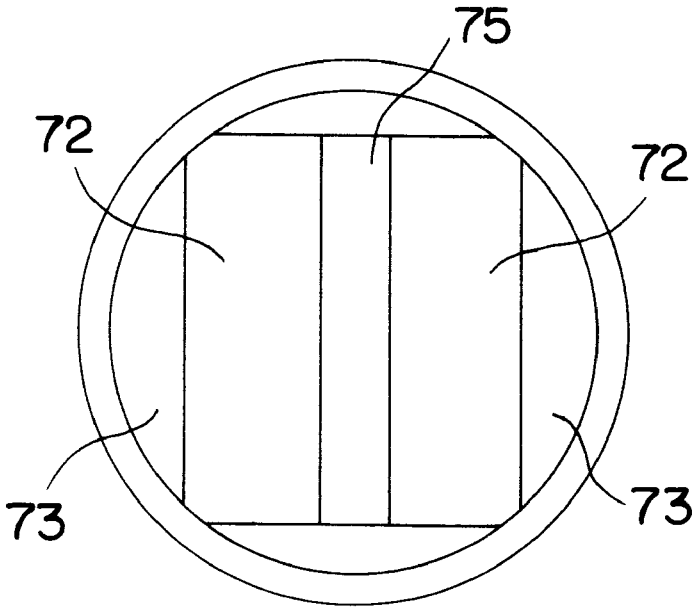
FIG. 8, a sectional view of the check valve taken along the line VIII—VIII of FIG. 6.

In the embodiment shown in FIGS. 6, 7 and 8, the check valve is formed by a partly split bolt 70 with a retaining collar 71, which is disposed in an opening 19, formed complementary to it, in the fuel delivery line in the nozzle body 10. On its side toward the combustion chamber, the bolt 70 has spring arms 72, which upon imposition of a pressure in the direction of the combustion chamber are pressed toward the axis 79 of the bolt 70, thereby opening an annular passage in the opening 19. The streamlined form of the spring arms 72 on their end toward the inlet conduit 14 has an especially advantageous effect. Upon pressure reduction, because of their spring action, they are pressed outward away from the axis 79 toward the opening 19 and close this opening.

As seen from FIG. 6 and particularly from FIG. 7, the fuel then flows through openings 73 disposed next to the spring arms 72.

The bolt 70, on its side toward the engine combustion chamber, has a blind opening 75 disposed centrally between the spring arms 72, into which opening returning fuel flows and is deflected, and as a result in this case an additional force is exerted outward on the spring arms 72.

As a result, in the presence of a very major force oriented away from the combustion chamber, the sealing action of the spring arms 72 of the bolt is increased.

The foregoing relates to preferred exemplary embodiments of the invention, it being understood that other variants and embodiments thereof are possible within the spirit and scope of the invention, the latter being defined by the appended claims.

What is claimed is:

1. A fuel delivery system for a fuel injection nozzle, inserted into a cylinder head of an internal combustion engine, comprising a tubular neck penetrating a passage in the cylinder head, the neck being tightly joined on an inlet side to a connection piece of an inlet tube and being pressed on an outlet side axially with a seat face against a conical seat face (12), disposed on the nozzle holder (10) of the fuel injection nozzle, by means of a union screw screwed into the passage of the cylinder head, a check valve is disposed downstream of the conical seat face (12) in the inlet conduit (14) of the injection nozzle, said check valve permits a delivery of fuel solely in a direction of the combustion chamber of the engine, the check valve includes a sealing sleeve (20), disposed in an opening, and on one end of the sealing sleeve (20) conical sealing faces (21, 25) are disposed, and on another end of the sealing sleeve (20) a sealing element is provided, which upon imposition of a pressure oriented in a direction of the engine combustion chamber opens the sealing sleeve (20), and upon a pressure oriented in a reverse direction the sealing element tightly closes the sealing sleeve (20).

2. The fuel delivery system of claim 1, in which the sealing element is a throttle plate (30), which is partly passable and is disposed axially in an opening downstream of the sealing sleeve (20) between the sealing sleeve and a bearing face (41), said throttle plate upon imposition of a pressure oriented toward the combustion chamber is pressed by the sealing sleeve (20) toward the bearing face (41), the sealing sleeve thereby being opened, and which upon imposition of a pressure oriented away from the combustion chamber is pressed by the bearing face (41) away onto a plane surface (23) on the underside of the sealing sleeve (20), thereby closing the sealing sleeve.

3. The fuel delivery system of claim 2, in which the bearing face (41) is an annularly encompassing shoulder in the nozzle holder (10).

4. The fuel delivery system of claim 2, in which the bearing face (41) is embodied frustoconically.

5. The fuel delivery system of claim 2, in which the throttle plate (30) has a centrally disposed sealing face (31), whose diameter is greater than that of the opening (22) in the sealing sleeve (20) toward the combustion chamber, and that outside the sealing face it has passable openings (33), whose total cross section is greater than or equal to that of the inlet tube (14).

6. The fuel delivery system of claim 2, in which a slotted sleeve (50) provided with transverse grooves (51) is disposed, downstream of the throttle plate (30), in an opening (53) whose diameter is less than that of the throttle plate (30).

7. The fuel delivery system of claim 2, in which a stop bush (60) is press-fitted into the inlet conduit (14) downstream of the throttle plate (30) and has a central opening (61), which at least partly overlaps the opening or openings in the openings (33) disposed in the throttle plate (30).

8. The fuel delivery system of claim 2, in which the throttle plate (30) is a molded part of steel or ceramic.

9. The fuel delivery system of claim 3, in which a slotted sleeve (50) provided with transverse grooves (51) is disposed, downstream of the throttle plate (30), in an opening (53) whose diameter is less than that of the throttle plate (30).

10. The fuel delivery system of claim 4, in which a slotted sleeve (50) provided with transverse grooves (51) is disposed, downstream of the throttle plate (30), in an opening (53) whose diameter is less than that of the throttle plate (30).

11. The fuel delivery system of claim 5, in which a slotted sleeve (50) provided with transverse grooves (51) is disposed, downstream of the throttle plate (30), in an opening (53) whose diameter is less than that of the throttle plate (30).

12. The fuel delivery system of claim 3, in which a stop bush (60) is press-fitted into the inlet conduit (14) downstream of the throttle plate (30) and has a central opening (61), which at least partly overlaps the opening or openings in the openings (33) disposed in the throttle plate (30).

13. The fuel delivery system of claim 4, in which a stop bush (60) is press-fitted into the inlet conduit (14) downstream of the throttle plate (30) and has a central opening (61), which at least partly overlaps the opening or openings in the openings (33) disposed in the throttle plate (30).

14. The fuel delivery system of claim 5, in which a stop bush (60) is press-fitted into the inlet conduit (14) downstream of the throttle plate (30) and has a central opening (61), which at least partly overlaps the opening or openings in the openings (33) disposed in the throttle plate (30).

15. The fuel delivery system of claim 3, in which the throttle plate (30) is a molded part of steel or ceramic.

16. The fuel delivery system of claim 4, in which the throttle plate (30) is a molded part of steel or ceramic.

17. The fuel delivery system of claim 5, in which the throttle plate (30) is a molded part of steel or ceramic.

18. A fuel delivery system for a fuel injection nozzle, inserted into a cylinder head of an internal combustion engine, comprising a tubular neck penetrating a passage in the cylinder head, the neck being tightly joined on an inlet side to a connection piece of an inlet tube and being pressed on an outlet side axially with a seat face against a conical seat face (12), disposed on the nozzle holder (10) of the fuel injection nozzle, by means of a union screw screwed into the passage of the cylinder head, a check valve is disposed downstream of the conical seat face (12) in the inlet conduit (14) of the injection nozzle, said check valve permits a delivery of fuel solely in a direction of the combustion chamber of the engine, the check valve is a partly split bolt (70) with a retaining collar (71), which is disposed in an opening (19), formed complementary to the split bolt, of the fuel delivery line and has spring arms (72), on a side toward the combustion chamber, that upon imposition of a pressure in a direction of the combustion chamber pressed toward an axis (79) of the bolt (70) and thereby open an annular passage in the opening (19), and that upon a pressure reduction yield radially outward away from the axis (79) in a direction of the opening (19) and close the opening (19).

19. The fuel delivery system of claim 18, in which the bolt (70), on the side toward the engine combustion chamber, has a blind opening (75) disposed centrally between the spring arms (72), into which opening returning fuel flows and is deflected and thereby exerts an additional force radially outward on the spring arms (72).

* * * * *